United States Patent [19]

Nakagami et al.

[11] 4,030,465

[45] June 21, 1977

[54] MULTI-CYLINDER INTERNAL COMBUSTION ENGINE

[75] Inventors: Tatsuro Nakagami, Kyoto; Yuhiko Kiyota, Nagaokakyo, both of Japan

[73] Assignee: Mitsubishi Jidosha Kogyo Kabushiki Kaisha, Tokyo, Japan

[22] Filed: Aug. 26, 1976

[21] Appl. No.: 718,196

[30] Foreign Application Priority Data

Oct. 22, 1975 Japan ..... 50-127806

[52] U.S. Cl. ..... 123/127; 123/119 R; 60/282

[51] Int. Cl.[2] ..... F02M 13/06

[58] Field of Search ..... 60/282; 123/127, 119 R, 123/75 B, 325 P

[56] References Cited

UNITED STATES PATENTS 3,708,980 1/1973 Truxell ..... 123/325 P

*Primary Examiner*—Ronald B. Cox

*Attorney, Agent, or Firm*—Wenderoth, Lind & Ponack

[57] ABSTRACT

An improved multi-cylinder internal combustion engine for producing cleaner exhaust gas. The engine has a novel fuel gas intake device in which a lean mixture gas having an air-to-fuel ratio of about 16–20 is fed almost uniformly to all the cylinders by means of a carburetor, and some of the cylinders are provided with a fuel addition passageway to supply an appropriate amount of additional fuel in accordance with various operation conditions of the engine in response to an opening angle and abrupt opening of a throttle valve of the carburetor so that a rich mixture gas having an air-to-fuel ratio of about 12–14 may be fed to such cylinders, whereby the amount of harmful gases, such as HC, CO and $NO_x$ in the exhaust, can be effectively reduced.

14 Claims, 8 Drawing Figures

MULTI-CYLINDER INTERNAL COMBUSTION ENGINE

BACKGROUND OF THE INVENTION AND PRIOR ART

The present invention relates to improvements in an internal combustion engine, especially in an internal combustion engine for automobiles. As is well-known in the art, in conventional gasoline engines for automobiles in which an air fuel mixture that is somewhat richer than a theoretical air-to-fuel ratio is burnt within a cylinder, a large amount of harmful gases, that is, $NO_X$, CO and HC, are contained in the exhaust gas. Among such harmful gases in the exhaust gas, HC and CO can be converted into harmless materials by burning them within a thermal reactor provided, for example, within an exhaust system or by oxidizing them with a catalytic converter. However, to this end, additional air serving as an oxygen source and normally called the secondary air must be supplied to the exhaust system, so that an air pump or another air source is required, resulting in an increase in the manufacturing cost of engines.

On the other hand, it has been known that gasoline engines have the following three characteristic performances:

1. As the air-to-fuel ratio of the gaseous mixture of air and fuel becomes excessively richer or excessively leaner than the theoritical air-to-fuel ratio, the $NO_x$ concentration in the exhaust gas produced by burning of the gaseous mixture becomes lower.

2. When a gaseous mixture, the air-to-fuel ratio of which is richer than the theoretical mixing ratio is burnt, generally the concentrations of CO and HC in the exhaust gas are high.

3. When a gaseous mixture, the air-to-fuel ratio of which is leaner than the theoretical mixing ratio is burnt, concentrations of CO and HC are low, if misfire does not occur.

(The term "air-to-fuel ratio" as used herein means the ratio of the amount of air (weight)/amount of fuel (weight) in the gaseous mixture.)

In the light of the above-mentioned three points, a multi-cylinder internal combustion engine in which an excessively lean gaseous mixture is fed to half of the cylinders but an excessively rich gaseous mixture is fed to the remaining half of the cylinders, has been already proposed. In this type of internal combustion engine, from the cylinders in which a lean mixture is burnt, there is discharged an exhaust gas which contains a relatively small amount of $NO_x$ and a small amount of CO and HC, but which contains a large amount of excess oxygen, whereas from the cylinders in which a rich mixture is burnt, there is discharged an exhaust gas which contains a relatively small amount of $NO_x$, a large amount of CO and HC and a small amount of excess oxygen.

Therefore, by mixing the exhaust gas discharged from the cylinders to which said rich gaseous mixture is fed and the exhaust gas discharged from the cylinders to which said lean gaseous mixture is fed within an exhaust system, the oxygen necessary for combustion of the CO and HC discharged mainly from the former cylinders can be supplied by the exhaust gas discharged from the letter cylinders, so that in an ideal case, feeding of secondary air is not necessary at all, and even if feeding of secondary air is necessary, the amount can be less than in the case of the conventional engines. Accordingly, there exists the advantage that an air pump or other air source serving as a secondary air source can be omitted or its capacity can be made extremely small.

However, with regard to the method for producing an excessively rich gaseous mixture in such type of internal combustion engine which has been proposed in the past as described above, since the general method for producing a gaseous mixture was by making use of a throttle valve and a negative suction pressure in a carburetor as heretofore employed in engines in general and by merely changing the cross-sectional area of the air suction pipe and the diameter of the fuel feed jet opening, the method had a disadvantage that the adjustment of the relative amounts of air and fuel in a lean mixture could not be maintained at an optimum over the entire operation range of an engine. More particularly, there were various disadvantages such as an increase of production of $NO_x$ from the cylinders to which a rich gaseous mixture is fed, and reduction of powder output from the cylinders to which a lean gaseous mixture is fed, both due to dilution of the gaseous mixture upon acceleration; increase of production of HC and CO from the cylinders to which a rich gaseous mixture is fed, and generation of after-burn both due to the concentration of the mixture upon deceleration; and excessive dilution of the lean gaseous mixture fed to all the cylinders, especially causing misfiring in the cylinders to which only a lean mixture gas is fed.

OBJECT AND BRIEF SUMMARY OF THE INVENTION

The present invention has as the object the elimination of the various disadvantages as described above, and the provision of an engine in which the rate of generation of $NO_x$ is effectively reduced, reduction of power output and stalling of the engine can be reliably prevented, and a stable engine output is assued. To this end, there is provided an engine according to the invention in which the cylinder to which a rich gaseous mixture and a lean gaseous mixture are fed there are also stably fed a rich gaseous mixture and a lean gaseous mixture having predetermined air-to-fuel ratios, respectively, regardless of various operating conditions of the engine.

BRIEF DESCRIPTION OF THE FIGURES

Other objects and advantages of the present invention will become more apparent from the following description of the preferred embodiments of the invention taken in conjunction with the accompanying drawings, in which.

DETAILED DESCRIPTION OF THE INVENTION

Figure 1:
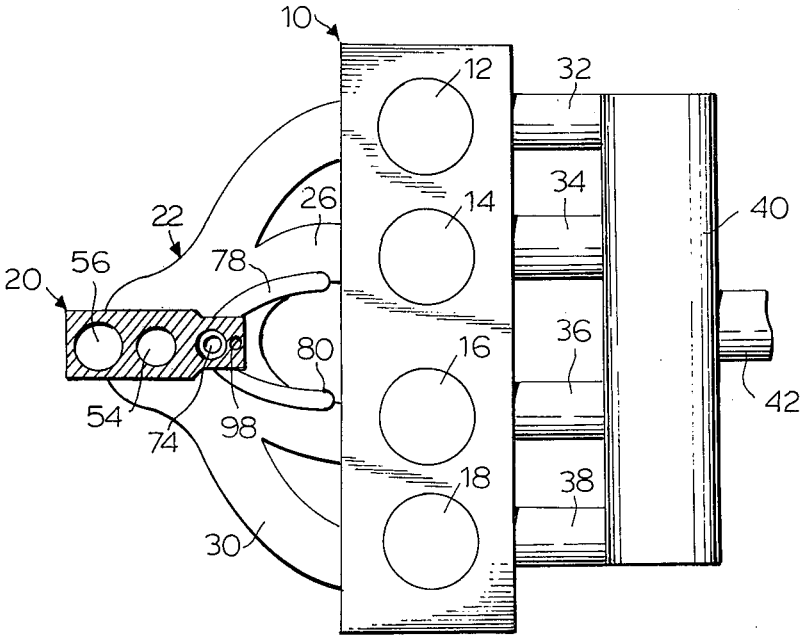
FIG. 1 is a schematic plan view partly in cross-section of a four-cylinder four-cycle gasoline engine assembly embodying the present invention.
Figure 2:
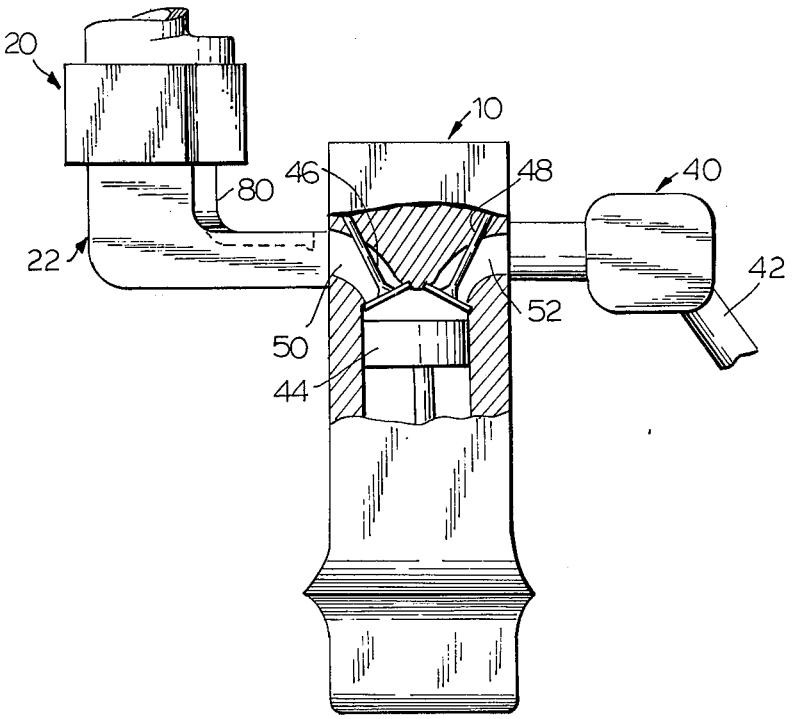
FIG. 2 is a schematic side view partly in cross-section of the same engine assembly.

Referring now to FIGS. 1 and 2 of the accompanying drawings which show one preferred embodiment of the present invention as applied to a four-cylinder, four-cycle gasoline engine, reference numeral 10 designates a main engine body, and numerals 12, 14, 16 and 18 designate four cylinders disposed in a line. These cylinders are fed with a gaseous mixture consisting of fuel and air from a twin type carburetor 20 as fully described later through an intake manifold 22. To the first cylinder 12 is connected a branch 24 of the intake manifold 22, to the second cylinder 14 is connected a branch 26, to the third cylinder 16 is connected a branch 28, and to the fourth cylinder 18 is connected a branch 30. In addition, the respective cylinders 12 to 18 are connected via respective exhaust pipes 32, 34, 36 and 38 to a thermal reactor or manifold reactor 40 which is in itself well-known. Exhaust gas cleaned within said thermal reactor or manifold reactor 40 is discharged to the atmosphere through an exhaust pipe 42. In FIG. 2, reference numeral 44 designates a piston located at a top dead center position, numeral 46 designates a suction valve, numeral 48 designates an exhaust valve, numeral 50 designates a suction port provided within a cylinder head, and numeral 52 designates an exhaust port provided within the same cylinder head.

Figure 3:
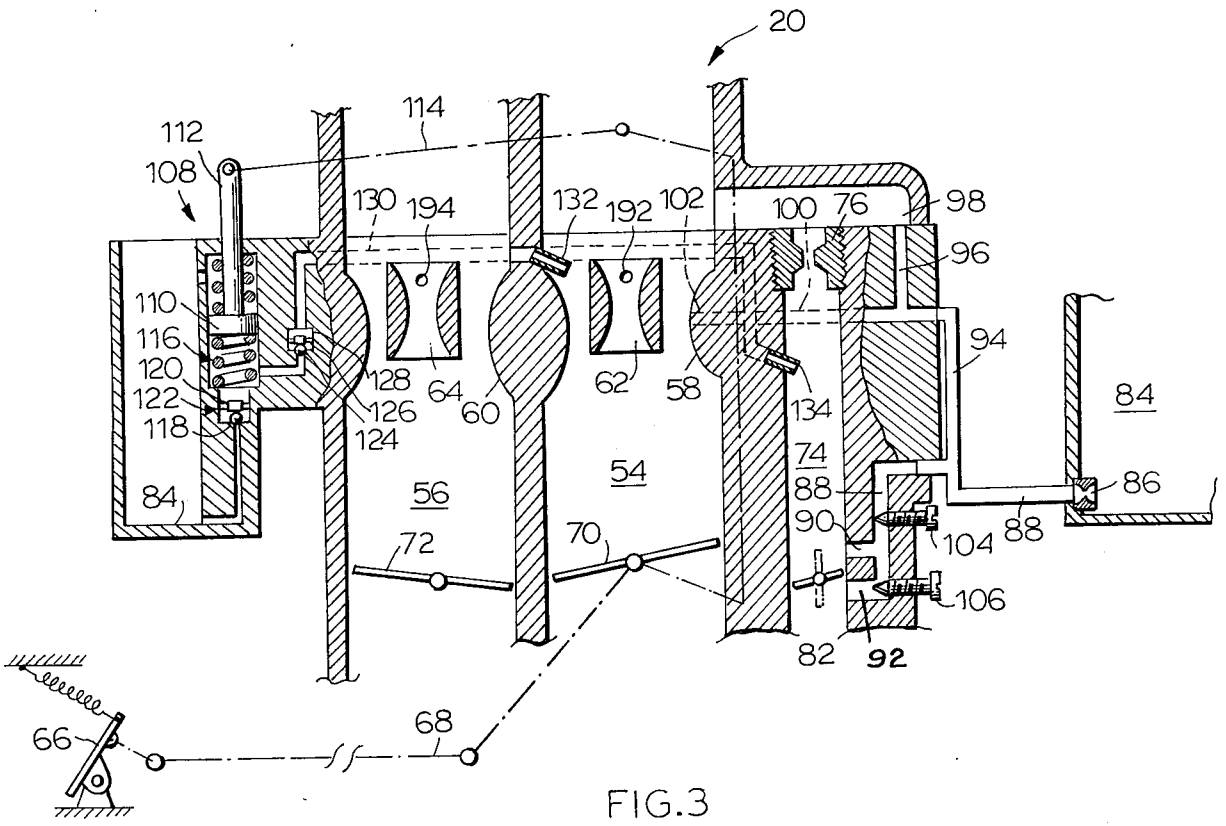
FIG. 3 is an enlarged vertical cross-section of a twin type carburetor in the engine assembly illustrated in FIGS. 1 and 2 according to a first preferred embodiment of the present invention.

As illustrated in detail in FIG. 3, the above-described twin type carburetor 20 is provided with a primary suction passageway 54 and a secondary suction passageway 56. The upper ends of both these passageways are communicated with the atmosphere through a conventional air cleaner not shown, while the lower ends thereof are communicated with a central portion of said suction manifold 22. In addition, within Venturi throats 58 and 60 of said primary and secondary suction passageways 54 and 56, respectively, are mounted inner Venturi tubes 62 and 64 substantially in a coaxial relation to the Venturi throats. Within the primary suction passageway 54, downstream of the Venturi throat 58 is disposed a primary throttle valve 70 which can be opened and closed by an acceleration pedel 66 shown schematically in the figure via a linkage or a cable, while within the secondary suction passageway 56, downstream of the Venturi throat 60 is disposed a secondary throttle valve 72 which is linked with said primary throttle valve 70 through a linkage mechanism as described later with reference to FIG. 4. Furthermore, on one side of the primary suction passageway 54 of the carburetor 20 is disposed a fuel addition passageway 74 parallel to said primay suction passageway 54. The fuel addition passageway 74 has its upstream end communicated with the primary suction passageway 54 at a point on the upstream side of the Venturi throat 58 through an orifice 76, and has the other end of the downstream side branched into two branches 78 and 80 which communicate with the intake manifold branches 26 and 28, respectively, leading to said second and third cylinders 14 and 16. Still further, in the middle portion of the fuel addition passageway 74 is disposed a tertiary throttle valve 82 which is opened and closed with the primary throttle valve 70 by a linkage mechanism which will be described later with reference to FIG. 5.

A fuel passageway 88 communicated with a float chamber 84 in the carburetor 20 through a main jet 86 is branched into two branch passageways or ports 90 and 92, one port 90 being open to the fuel addition passageway 74 on the upstream side of the tertiary throttle valve 82, and the other port 92 being open to the fuel addition passageway 74 on the downstream side of the tertiary throttle valve 82. To the fuel passageway 88 is connected an air passageway 94, one branch 96 of which is communicated with the primary suction passageway 54 on the upstream side of the Venturi throat 58 through an air bleed 98, and the other branch 100 of which is open to the Venturi throat 58 of the primary suction passageway 54 through an air bleed 102. Reference numeral 104 designates a metering screw for adjusting the flow rate of a mixture consisting of fuel from passage 88 and air entering through the air passageway 94 which flows through the fuel passageway 88, and numeral 106 designates a pilot screw of metering the flow rate of the mixture flowing out of the port 92.

In addition, the carburetor 20 is provided with a mechanical type of accelerating pump system 108 that is in itself well-known. A rod 112 is connected to a pump piston 110 is linked with the primary throttle valve 70 through a linkage mechanism 114 represented schematically by a single dot chain line 114 in FIG. 3. A pump chamber 116 communicates, on one hand, with a float chamber 84 via a check valve 122 consisting of a ball 118 and a valve weight 120, and this check valve 122 permits only a flow of fuel from the float chamber 84 into the pump chamber 116. On the other hand, the pump chamber 116 communicates with a fuel delivery passageway 130 via a check valve 128 consisting of a ball 124 and a valve weight 126, and this check valve 128 permits only a flow of fuel from the pump chamber 116 to the fuel delivery passageway 130 and does not permit flow in the opposite direction. Since the abovedescribed pump piston 110 is fitted in the pump chamber with a predetermined looseness, when the primary throttle valve 70 is slowly opened, the fuel within the pump chamber 116 merely flows through the clearance between the piston 110 and the chamber wall of the chamber 116 to the chamber above said piston without the piston 110 effecting a pumping action, but when the primary throttle valve 70 is quickly opened for the purpose of quick acceleration, the fuel within the chamber 116 flows through the check valve 128 to te delivery passageway 130, so that fuel is injected through a pump jet 132 opening to the primary suction passageway 54 and a pump jet 134 opening to the fuel addition passageway 74 as an additional accelerating fuel required for quick acceleration.

A description will now be given of the linkage mechanisms between the primary throttle valve 70, the secondary throttle valve 72, the tertiary throttle valve 82 and the negative pressure responsive device 152 with reference to FIGS. 4 and 5.

Figure 4:
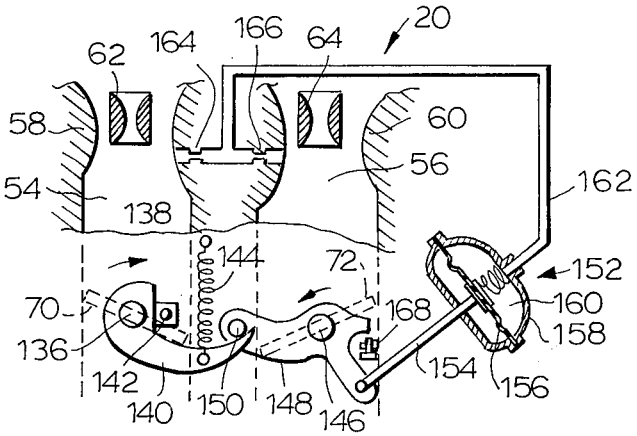
FIG. 4 is a partial cross-section of the twin type carburetor in FIG. 3 showing a linkage mechanism between a first throttle valve, a second throttle valve and a negative pressure responsive device.

First referring to FIG. 4, a first lever 138 is fixedly secured to an outwardly projecting portion of a valve stem 136 for rotatably supporting the primary throttle valve 70 with respect to a housing of the carburetor 20, and also on said projecting portion is rotatably supported a second lever 140 so as to be freely rotatable with respect to said valve shaft 136. On said first lever 138 is provided a stop pin 142 projecting therefrom, and the second lever 140 is normally subjected to a torque in the counterclockwise direction by means of a spring 144 having one end anchored to the second lever 140 near the free end thereof and the other end anchored to the housing of the carburetor. On the other hand, a third lever 148 is fixedly secured to an outwardly projecting portion of a valve shaft 146 for rotatably supporting the secondary throttle valve 72 with respect to the housing of the carburetor 20. A pin 150 is mounted on one end of said third lever 148 and projecting therefrom, and said pin 150 is contacted by the free end portion of said second lever 140. Also to the other end of said third lever 148 is connected a rod 154 of the negative pressure responsive device 152. Said negative pressure responsive device 152 comprises a negative pressure chamber 160 defined by a diaphragm 156 and a housing 158, and said negative pressure chamber 160 is communicated with the primary Venturi throat 58 and the secondary Venturi throat 60 of the carburetor 20 through a pipe 162 and orifices 164 and 166. In other words, in the negative pressure chamber 160 there is produced a negative pressure obtained by combining the Venturi tube negative pressures in the primary and secondary systems; that is, a negative pressure corresponding to the overall inlet air flow rate of the engine.

In the illustrated state, the primary throttle valve 70 is in a fully closed position, that is, at an idling angle position, and the secondary throttle valve 72 is in a fully closed position. Starting from this state, if the primary throttle valve 70 is opened in response to the load upon the engine, then the first lever 138 will rotate jointly with the valve 70, and when the valve 70 reaches a certain angle of opening such as, for example, a 50% opening angle, the stop pin 142 engages with the second lever 140, which rotates thereafter jointly with the first lever 138 in the clockwise direction against the biasing resilient force of the spring 144. In response to the rotation of the second lever 140, the constraining force of the spring 144 which has biased the third lever 148 to its fully closed position via the pin 150 is released, so that the third lever 148 thereafter comes under control of the negative pressure responsive device 152 and is maintained at an opening angle corresponding to an intake air flow rate of the engine. In FIG. 4, reference numeral 168 designates a stop member mounted on the housing of the carburetor 20 so as to cooperate with said third lever 148 to limit the fully closed position of said lever.

Figure 5:
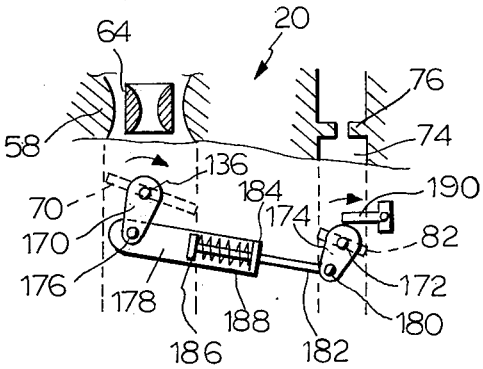
FIG. 5 is another partial cross-sectional view of the twin type carburetor as shown in FIG. 3 showing a linkage mechanism between a first throttle valve and a tertiary throttle valve.

Now referring to FIG. 5 which schematically shows only the linkage mechanism between the primary throttle valve 70 and the tertiary throttle valve 82, a fourth lever 170 is fixedly secured to the portion of the valve shaft 136 of the primary throttle valve 70 projecting out of the carburetor housing, and a fifth lever 174 is fixedly secured to the portion of a valve shaft 172 of the tertiary throttle valve 82 projecting out of the carburetor housing. To the free end of the fourth lever 170 is pivotably mounted one end of a rod 178 by means of a pin 176, and to a free end of the fifth lever 174 is pivotably mounted one end of a rod 182 by means of a pin 180. The other end portion of the rod 182 loosely extends through a hole in an L-shaped bent portion 184 provided at the other end of the rod 178, and a spring 188 is interposed between a head 186 of the rod 182 and said bent portion 184.

In the illustrated state, the primary throttle valve 70 is at an opening angle for idling and the tertiary throttle valve is fully closed. Starting from this state, if the primary throttle valve 70 is opened, then the fourth lever 170 also rotates jointly with said valve 70, so that the rod 178 is displaced leftwards as viewed in FIG. 5. In response to the leftward displacement of the rod 178, the rod 182 is also displaced leftwards via the spring 188, so that the fifth lever 174 rotates to open the tertiary throttle valve 82. Then, as the angle of opening of the primary throttle valve 70 is increased, the fifth lever 174 will abut against a stop 190 fixedly secured on the carburetor housing, and thereafter the spring 188 is compressed between the rod head 186 and the bent portion 184 of the rod 178, so that the primary throttle valve 70 continues to be opened independently of the tertiary throttle valve 82. As will be obvious from FIG. 5, the relationship between the opening angle of the primary throttle valve 70 and the opening angle of the tertiary throttle valve 82 can be freely designed by appropriately selecting the lengths of the fourth and fifth levers 170 and 174 and their mounting angles relative to the respective valve stems 136 and 172, and the maximum opening angle of the tertiary throttle valve 82 can be arbitrarily adjusted by setting the position of the stop 190.

It is to be noted that FIGS. 4 and 5 show the linkage mechanisms between the primary and secondary throttle valves and between the primary and tertiary throttle valves separately for avoiding complexity of the drawings. However, these linkage mechanisms could be disposed on the same side surface of the carburetor housing (that is, on the projecting portions on the same side of the valve stems 136 and 172), or they could be disposed separately on the opposite side surfaces. In addition, the carburetor 20 is provided with a low speed or slow system for mainly dealing with idling, off-idling and light load operations and a main metering system for mainly dealing with a normal speed operation. However, since these systems are substantially equivalent to those used in conventional carburetors, and since they are not directly related to the present invention, in order to avoid complexity of the drawings, only a main nozzle 192 on the primary side and a main nozzle 194 on the secondary side are illustrated in FIG. 3, and the remaining portions of these systems are omitted from the drawings.

In the engine illustrated in FIGS. 1 and 2 which comprises the carburetor 20 shown in FIG. 3, a lean mixture, the air-to-fuel ratio of which is regulated, for example, to about 16-20, is fed from the carburetor 20 through the intake manifold 22 and the manifold branches 24, 26, 28 and 30 to the first to fourth cylinders 12, 14, 16 and 18. On the other hand, a super-rich mixture, the air-to-fuel ratio of which is regulated, for example, to about 1–2, is fed from the branches 78 and 80 of the fuel addition passageway 74 to the interiors of the manifold branches 26 and 28 leading to the second and third cylinders 14 and 16. As a result, within the manifold branches 26 and 28 of the second and third cylinders 14 and 16, said lean gaseous mixture, the air-to-fuel ratio of which is about 16–20 and said super-rich gaseous mixture, the air-to-fuel ratio of which is about 1–2, are mixed into a rich gaseous mixture, the air-to-fuel ratio of which is about 12–14, and said rich gaseous mixture is fed to the second and third cylinders 14 and 16.

Explaining the aforementioned operation in more detail, to the fuel addition passageway 74 is fed air from the primary suction passageway 54 on the upstream side of the Venturi throat 58 through the orifice 76, also the fuel within the float chamber 84 is led to the fuel passageway 88 through the main jet 86, and midway thereof, the fuel is mixed with air that is sucked into the air passageway 94 through the air bleeds 98 and 102. This aqueous mixture is led to the ports 90 and 92 after having been adjusted by the metering screw 104, the gaseous mixture led to the latter port 92 being further adjusted by the pilot screw 106, and then the gaseous mixture is sucked into the fuel addition passageway 74 through both said ports.

As described previously, the tertiary throttle valve 82 within the fuel addition passageway 74 is opened, since it is linked with the primary throttle valve 70, and in the illustrated embodiment, as represented by dotted lines in FIG. 3, the linkage is preset in such a manner that when the primary throttle valve 70 has been opened to an angle of about 20°, the tertiary throttle valve 82 may already be fully opened. Accordingly, after the tertiary throttle valve 82 has been fully opened, the flow rate of fuel fed from the fuel passageway 88 is regulated by the variation of the rate of air sucked from the air bleeds 98 and 102 into the air passageway 94. More particularly, since the negative pressure within the Venturi throat 58 is increased in proportion to the increase of the suction air flow rate in the primary suction passageway 54, the flow rate of the air flowing from the air bleed 102 into the air passageway 94 is decreased substantially in inverse proportion to the angle of opening of the primary throttle valve 70, and thus the flow rate of the fuel fed from the main jet 86 is increased by the corresponding amount, and eventually, the flow rate of the fuel flowing into the fuel addition passageway 74 will be increased substantially in proportion to the increase of the angle of opening of the primary throttle valve 70.

When an engine is quickly accelerated from a light load condition, upon abrupt opening of the primary and tertiary throttle valves 70 and 82 to a large angle of opening, the air, having a small specific gravity, will quickly respond to the variation of the angle of opening of the valves to increase the flow rate, but the fuel having a relatively large specific gravity will respond to the variation of the angle of opening of the valves to increase the flow rate more slowly, so that temporarily the lean gaseous mixture fed to the first to fourth cylinders tends to become leaner and simultaneously the super-rich gaseous mixture fed from the fuel addition passageway 74 to the second and third cylinders also tends to become leaner. Consequently, in the first and fourth cylinders to which only the lean gaseous mixture is fed, there arises the danger of a misfire, and on the other hand, since the air-to-fuel ratio of the rich gaseous mixture consisting of a mixture of the lean gaseous mixture and the super-rich gaseous mixture comes near the theoretical air-to-fuel ratio, in the second and third cylinders there arises a danger that the combustion temperature is raised and consequently the concentration of $NO_x$ in the exhaust gas is increased. In the above-described embodiment, however, the accelerating pump system 108 operates upon quick acceleration to feed fuel for acceleration from the pump jets 132 and 134 to the primary suction passageway 54 and the fuel addition passageway 74, and as a result, misfire in the first and fourth cylinders can be prevented and also the approach of the air-to-fuel ratio of the rich gaseous mixture fed to the second and third cylinders to the theoretical air-to-fuel ratio can be prevented, so that an increase of the concentration of $NO_x$ in the exhaust gas can be suppressed.

Figure 6:
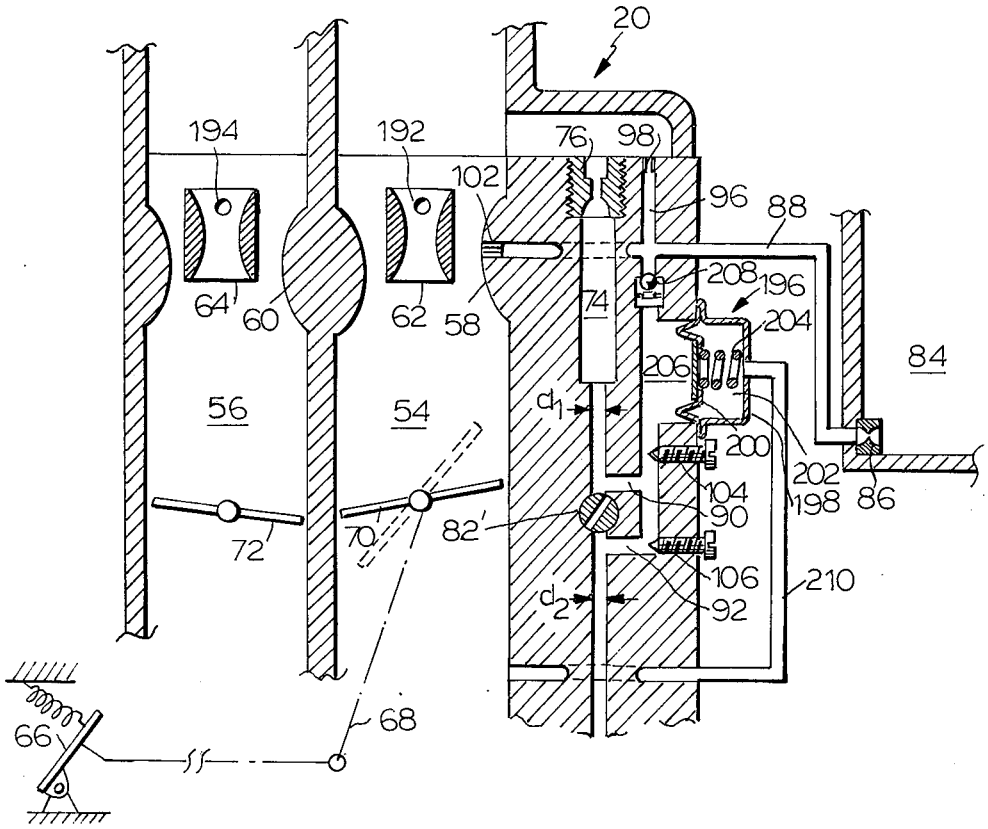
FIG. 6 is an enlarged vertical cross-section of a twin type carburetor in the engine assembly illustrated in FIGS. 1 and 2 according to a second preferred embodiment of the present invention.

Now a second preferred embodiment of the present invention will be described with reference to FIG. 6. This preferred embodiment is a modification of the above-described first preferred embodiment in that the tertiary throttle valve 82 in the fuel addition passageway 74 is changed from a butterfly type of valve to a rotary valve 82′, and in that the pump jet 134 is omitted and in place of said pump jet 134 a diaphragm type of accelerating pump 196 is connected to the fuel passageway 88. The remaining structure of this preferred embodiment is substantially similar to the above-described first preferred embodiment. Also, the linkage mechanism between the primary throttle valve 70 and the secondary throttle valve 72, and the linkage mechanism between the primary throttle valve 70 and the tertiary throttle valve 82′ are substantially the same as those illustrated in FIGS. 4 and 5, respectively.

The above-mentioned accelerating pump 196 has a negative pressure chamber 202 delimited by a housing 198 and a diaphragm 200, a spring 204 being positioned within said negative pressure chamber 202, and a pump chamber 206 delimited within the carburetor housing by said diaphragm 200. The pump chamber 206 is provided with a check valve 208 for preventing the fuel within said chamber from flowing back toward the float chamber 84 upon pumping, and the negative pressure chamber 202 is communicated with the primary suctionpassageway 54 on the downstream side of the primary throttle valve 70 through a negative pressure passageway 210. Accordingly, upon quick acceleration of the engine, when the primary throttle valve 70 has been quickly opened and the negative pressure in the suction passageway 54 has been abruptly reduced, the diaphgram 200 which was sucked rightwards as viewed in FIG. 6 by the large negative pressure within the suction passageway 54 prior to that time, is displaced leftwards, as viewed in FIG. 6, due to the resilient force of the spring 204. Consequently, the fuel held within the pump chamber 206 is injected from the ports 90 and 92 into the fuel addition passageway 74, and thereby, similarly to the case of the above-described first preferred embodiment of the invention, dilution of the gaseous mixture at the time of acceleration can be prevented. However, when the engine is running in a stable or stationary state, no variation of negative pressure arises within the suction passageway 54 and thus the diaphragm 200 is not displaced, so that the action of an accelerating pump is not effected and the pump chamber 206 merely serves as a part of the fuel passageway 88. In addition, upon deceleration such as, for example, engine braking, because of the abrupt increase of the negative pressure within the suction passageway 54, the diaphragm 200 is sucked rightwards, as viewed in FIG. 6, against the biasing resilient force of the spring 204, so that the fuel within the fuel passageway 88 on the upstream side and on the downstream side of the pump chamber 206 flows into said pump chamber and thus the flow rate of the fuel flowing through the ports 90 and 92 is reduced temporarily. Consequently, the concentration of the gaseous mixture fed to the second and third cylinders is lowered, resulting in improvement of fuel consumption, and simultaneously the amounts of harmful unburnt gases, such as HC, CO, etc. in the exhaust gas, are reduced, and further, additional effects, such as prevention of generation of after burn, can be attained.

The air-to-fuel ratio characteristics of the above-described second preferred embodiment will now be explained on the basis of some experimental data. In the construction shown in FIG. 6, when the diameter $d_1$ of the small diameter portion of the fuel addition passageway 74 on the upstream side of the throttle valve 82' is 3 mm, the diameter of the cylindrical bore drilled in the throttle valve 82' is 3 mm, the diameter $d_2$ of the fuel addition passageway 74 on the downstream side of said valve is 4 mm, the diameter of the orifice 76 is 3 mm, the diameter of the air bleed 102 is 2.5 mm, the diameter of the air bleed 98 is 1.9 mm, and the diameter of the main jet 86 is 0.5 mm, then the relation between the variation of the intake manifold negative pressure and the air-to-fuel ratio under a stationary running condition of the engine at a rotational speed of 200 rpm, is as shown in FIG. 7.

Figure 7:
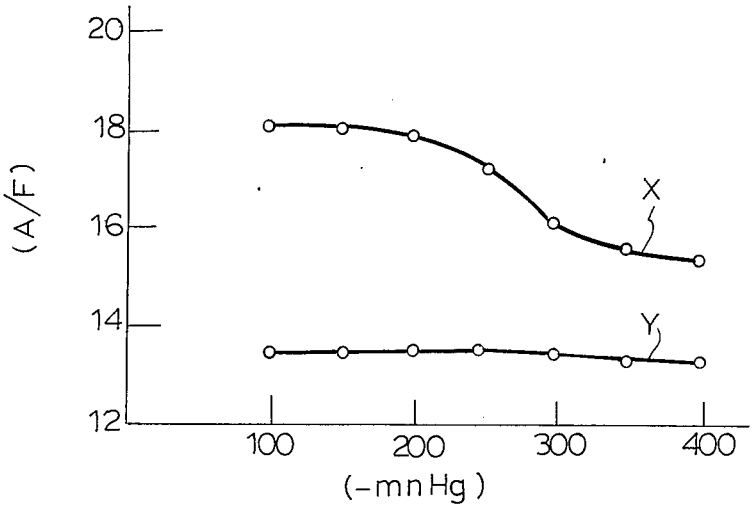
FIG. 7 is a diagram showing variations of air-to-fuel ratios of a lean gaseous mixture and a rich gaseous mixture, respectively, to be fed to an engine according to the present invention as functions of the intake manifold negative pressure.

In FIG. 7, the solid line curve X represents the air-to-fuel ratio characteristics of the gaseous mixture fed to the first and fourth cylinders 12 and 18, and the solid line curve Y represents air-to-fuel ratio characteristics of the gaseous mixture fed to the second and third cylinders 14 and 16. As will be obvious from this figure, the air-to-fuel ratio of the rich gaseous mixture fed to the second and third cylinders is a substantially constant value of13, regardless of the intake manifold negative pressure, that is, regardless of the magnitude of the load upon the engine, whereas the air-to-fuel ratio of the lean gaseous mixture fed to the first and fourth cylinders has a somewhat rich value of 15.5 in the region of a relatively large intake manifold negative pressure, that is, in the light loading region of the engine, but has a lean value of 18 in the region of a small intake manifold negative pressure, that is, in the heavy loading region of the engine. Accordingly, in the light loading region of the engine where the generation rate of $NO_x$ is generally small, the air-to-fuel ratio in the first and fourth cylinders is adjusted to a value near the theoretical mixing ratio and thereby lowering of power output of the engine can be prevented, whereas in the heavy loading region of the engine, where the generation of $No_x$ is generally large, the air-to-fuel ratio in said first and fourth cylinders is increased, resulting in reduction of the generation rate of $NO_x$.

Figure 8:
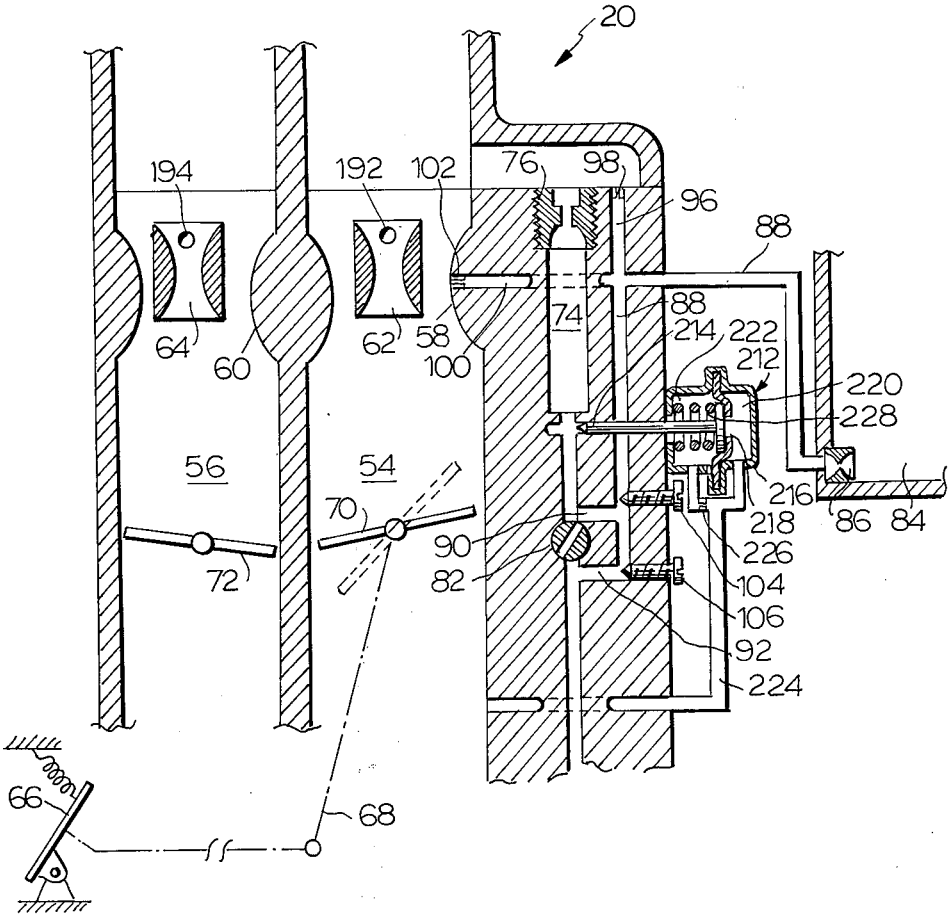
FIG. 8 is an enlarged vertical cross-section of a twin type carburetor in the engine assembly illustrated in FIGS. 1 and 2 according to a third preferred embodiment of the present invention.

A third preferred embodiment of the present invention will be described with reference to FIG. 8. In this preferred embodiment, in place of the accelerating pump 196 in the abovedescribed second preferred embodiment, an acceleration detector 212 is provided, and in addition, there is provided a valve 214 for opening and closing the fuel addition passageway 74 in response to the operation of said acceleration detector 212. With regard to the remaining structure, this preferred embodiment is substantially the same as the second preferred embodiment.

Said acceleration detector 212 comprises a housing 216, the interior of which is partitioned into a first chamber 220 and a second chamber 222 by means of a diaphragm 218. The first chamber 220 is directly communicated with the primary suction passageway 54 of the carburetor on the downstream side of the primary throttle valve 70 through a negative pressure passageway 224, while the second chamber 222 is communicated with said negative pressure passageway 224 through an orifice 226. At the center portion of the diaphragm 218 is fixedly secured the stem of the valve 214. Within said second chamber 222 is positioned a spring 228, which urges the diaphragm 218 rightwards as viewed in FIG. 8, that is, in the direction for opening the valve 214.

When the engine is running steadily, since the same negative pressure within the primary suction passageway 54 is acting upon the first chamber 220 and the second chamber 222, the diaphragm 218 is urged rightwards by the spring 228, so that the valve 214 opens the fuel addition passageway 74. However, when the engine is quickly accelerated, the negative pressure within said suction passageway 54 falls abruptly, so that the negative pressure within the first chamber 220 is lowered while following the change of the negative pressure within the suction passageway 54 without delay, but the negative pressure within the second chamber 222 is lowered only after some delay due to the resistance of the orifices 226, and therefore, a pressure difference is generated between these chambers 220 and 222. Due to this pressure difference, the diaphragm 218 is displaced leftwards against the biasing resilient force of the spring 228, and as a result, the valve 214 is also displaced leftwards to close the fuel addition passageway 74.

Accordingly, upon acceleration, air is not sucked through the orifice 76 at the upstream end of the fuel addition passageway 74, so that the flow rate of the additional fuel fed to the branches 78 and 80 (FIG. 1) at the downstream of said passageway 74 is increased, and thereby dilution of the gaseous mixture fed to the second and third cylinders upon acceleration can be prevented and the increase of the exhaust rate of $NO_x$ from these cylinders can be prevented.

Since many changes could be made in the above construction and many apparently widely different embodiments of this invention could be made without departing from the scope thereof, it is intended that all matter contained in the above description or shown in the accompanying drawings shall be interpreted as illustrative and not in a limiting sense.

What is claimed is:

1. A multi-cylinder internal combustion engine comprising:

a. a plurality of cylinders;

b. a carburetor for feeding a lean gaseous mixture of fuel and air to said plurality of cylinders and having an air intake with a Venturi portion and a throttle valve therein;

c. an intake manifold having branches connected between said carburetor and said cylinders for distributing the lean gaseous mixture from said carburetor to all said plurality of cylinders; and d. fuel adding means for feeding a rich gaseous mixture of fuel and air to some of said branches of said intake manifold, said fuel adding means having:

$d_1$. an air passageway device having an upstream end and having an orifice at said upstream end communicated with the atmosphere and having a downstream end communicated with the manifold branches for said some of cylinders;

$d_2$ . a throttle valve device in said air-passageway device between the upstream end and the downstream end;

$d_3$. a fuel feed passageway communicated with said air passageway device both on the upstream side and on the downstream side of said throttle valve device;

$d_4$. a fuel source connected to said fuel feed passageway; and $d_5$. an air passageway connected between a middle portion of said fuel feed passageway and the Venturi portion of said carburetor.

2. A multi-cylinder internal combustion engine as claimed in claim 1 further comprising a valve linkage mechanism linking said throttle valve in said additional fuel feed passageway with said throttle valve of said carburetor.

3. A multi-cylinder internal combustion engine as claimed in claim 2 in which said valve linkage mechanism includes means for fully opening the throttle valve of the additional fuel feed passageway when the throttle valve of the carburetor is at a small opening angle.

4. A multi-cylinder internal combustion engine as claimed in claim 3 in which said valve linkage mechanism comprises a lever on the shaft of said carburetor throttle valve and a lever on the shaft of said air passageway throttle valve, two aligned link members connected to the respective levers and spring means engaged between said link members urging them toward each other.

5. A multi-cylinder internal combustion engine as claimed in claim 1 in which said carburetor throttle valve is a primary throttle valve and said carburetor has a secondary air intake passageway having a secondary throttle valve therein, and a linkage between said throttle valves comprising a curved link on the shaft of said primary throttle valve and an L-shaped lever on the shaft of the secondary throttle valve having a longer leg with a pin on the end thereof and extending toward said primary throttle valve, spring means coupled to the curved lever on the shaft of said primary throttle valve and urging said curved lever against the pin on said longer leg of said L-shaped lever, said curved lever having a length to be swung out of the path of movement of said pin when said primary throttle valve is fully open, and a negative pressure responsive device coupled to the air intakes of said carburetor and responsive to the negative pressure therein and having a movable member linked to the other leg of said L-shaped lever for moving said L-shaped lever in response to the negative pressure in said carburetor after said primary throttle valve reaches the fully open position.

6. A multi-cylinder internal combustion engine as claimed in claim 2, further comprising an acceleration fuel pump coupled to said fuel source and to said carburetor for pumping fuel when the carburetor is suddenly actuated for increasing the flow of air and fuel therethrough, and said carburetor having a further fuel passageway connected to the output side of said acceleration fuel pump and opening into said additional fuel feed passageway.

7. A multi-cylinder internal combustion engine as claimed in claim 1 further comprising an acceleration fuel pump in said additional fuel feed passageway between a float chamber and said throttle valve for increasing the flow of fuel through said additional fuel feed passageway when the carburetor is suddenly actuated for increasing the flow of air and fuel therethrough.

8. A multi-cylinder internal combustion engine as claimed in claim 7 further comprising a check valve in said additional fuel feed passageway on the upstream side of said acceleration fuel pump.

9. A multi-cylinder internal combustion engine as claimed in claim 8 in which said acceleration fuel pump consists of a pump chamber communicated with said fuel feed passageway, a negative pressure chamber, a diaphragm partitioning said negative pressure chamber from said pump chamber, a spring within said negative pressure chamber and acting on said diaphragm for urging it toward said pump chamber, and a negative pressure passageway communicating said negative pressure chamber with the downstream side of the throttle valve in said carburetor.

10. A multi-cylinder internal combustion engine as claimed in claim 9 in which the throttle valve provided in said additional fuel feed passageway is a rotary valve.

11. A multi-cylinder internal combustion engine as claimed in claim 10 in which said fuel feed passageway has an air inlet connected thereto substantially at the point where said air passageway is connected to said fuel feed passageway.

12. A multi-cylinder internal combustion engine as claimed in claim 11, in which the diameter of said air passageway device on the downstream side of a rotary valve is greater than the diameter of said air passageway device on the upstream side of said rotary valve or the diameter of the opening of said air passageway into the Venturi portion of said carburetor or the diameter of said air inlet or the diameter of the connection between said fuel source and said fuel feed passageway, and in which a diameter of the orifice of said air passageway on the upstream side of said rotary valve and the diameter of the bore in said rotary valve are substantially equal to the diameter of said air passageway on the upstream side of said rotary valve.

13. A multi-cylinder internal combustion engine as claimed in claim 1 further comprising an acceleration detector connected to said carburetor, and a shut-off valve in said additional fuel feed passageway on the upstream side of the throttle valve and coupled to and responsive to said acceleration detector and for fully closing said additonal fuel feed passageway upon acceleration.

14. A multi-cylinder internal combustion engine as claimed in claim 13 in which said acceleration detector consists of a casing, a diaphragm dividing said casing into two chambers, a spring in one chamber and biasing said diaphragm in the direction of opening said shut-off valve upon normal running, a negative pressure passageway connecting one of said two chambers with the portion of the carburetor on the downstream side of the throttle valve, and a further negative pressure passageway branched from said firstmentioned negative pressure passageway connected to the other chamber and having a restricting orifice therein.

* * * * *